US005927571A

United States Patent [19]

Richards

[11] Patent Number: 5,927,571

[45] Date of Patent: Jul. 27, 1999

[54] CONVERTIBLE HANGER

[76] Inventor: Debbie Richards, 4 Creasy Close, Abbotts Langley, United Kingdom, WD5 OHS

[21] Appl. No.: 09/124,733

[22] Filed: Jul. 30, 1998

[51] Int. Cl.[6] ..... A47G 25/18

[52] U.S. Cl. ..... 223/88; 223/DIG. 4

[58] Field of Search ..... 223/DIG. 4, 88, 223/85, 92, 89, 94

[56] References Cited

U.S. PATENT DOCUMENTS

| | | | |
|---|---|---|---|
| 2,232,249 | 2/1941 | Losin | 223/DIG. 4 |
| 2,454,698 | 11/1948 | Hippler | 223/DIG. 4 |
| 2,556,461 | 6/1951 | Baron | 223/DIG. 4 |
| 2,929,538 | 3/1960 | Douglass | 223/94 |
| 3,017,059 | 1/1962 | Dzienisiewicz | 223/DIG. 4 |
| 5,085,357 | 2/1992 | Chen | 223/94 |
| 5,303,855 | 4/1994 | Veale | 223/85 |

*Primary Examiner*—Bibhu Mohanty

[57] ABSTRACT

A new convertible hanger for accommodating different sizes and styles of garments. The inventive device includes a hooked upper portion adapted for engaging a coat rail. The hooked upper portion has an upper hooked end and pair of outwardly angled arm segments. The upper hooked end has an engagement bar pivotally positioned within an opening thereof. The engagement bar has a lever coupled therewith. The lever has an outer free end extending outwardly opposed from the opening of the upper hooked end. The outwardly angled arm segments each have a male coupling disposed on a free end thereof. A pair of shirt attachment rods are provided with each having female couplings disposed on opposed free ends thereof. The female couplings of one of upper free ends removably mate with the male couplings of the hooked upper portion for supporting a shirt thereon.

5 Claims, 4 Drawing Sheets

CONVERTIBLE HANGER

BACKGROUND OF THE INVENTION

1. Field of the Invention

The present invention relates to hangers and more particularly pertains to a new convertible hanger for accommodating different sizes and styles of garments.

2. Description of the Prior Art

The use of hangers is known in the prior art. More specifically, hangers heretofore devised and utilized are known to consist basically of familiar, expected and obvious structural configurations, notwithstanding the myriad of designs encompassed by the crowded prior art which have been developed for the fulfillment of countless objectives and requirements.

Known prior art hangers include U.S. Pat. No. 5,018,650 to Mauffette; U.S. Pat. No. 5,085,358 to Lam; U.S. Pat. No. 4,168,791 to Clark, Jr.; U.S. Pat. No. 4,759,480 to Duester et al.; U.S. Pat. No. 5,046,649 to Hazeveld; and U.S. Pat. No. Des. 356,894 to Andersson.

While these devices fulfill their respective, particular objectives and requirements, the aforementioned patents do not disclose a new convertible hanger. The inventive device includes a hooked upper portion adapted for engaging a coat rail. The hooked upper portion has an upper hooked end and pair of outwardly angled arm segments. The upper hooked end has an engagement bar pivotally positioned within an opening thereof. The engagement bar has a lever coupled therewith. The lever has an outer free end extending outwardly opposed from the opening of the upper hooked end. The outwardly angled arm segments each have a male coupling disposed on a free end thereof. A pair of shirt attachment rods are provided with each having female couplings disposed on opposed free ends thereof. The female couplings of one of upper free ends are removably mating with the male couplings of the hooked upper portion for supporting a shirt thereon.

In these respects, the convertible hanger according to the present invention substantially departs from the conventional concepts and designs of the prior art, and in so doing provides an apparatus primarily developed for the purpose of accommodating different sizes and styles of garments.

SUMMARY OF THE INVENTION

In view of the foregoing disadvantages inherent in the known types of hangers now present in the prior art, the present invention provides a new convertible hanger construction wherein the same can be utilized for accommodating different sizes and styles of garments.

The general purpose of the present invention, which will be described subsequently in greater detail, is to provide a new convertible hanger apparatus and method which has many of the advantages of the hangers mentioned heretofore and many novel features that result in a new convertible hanger which is not anticipated, rendered obvious, suggested, or even implied by any of the prior art hangers, either alone or in any combination thereof.

To attain this, the present invention generally comprises a hooked upper portion adapted for engaging a coat rail. The hooked upper portion has an upper hooked end and pair of outwardly angled arm segments. The upper hooked end has an engagement bar pivotally positioned within an opening thereof. The engagement bar has a lever coupled therewith. The lever has an outer free end extending outwardly opposed from the opening of the upper hooked end. The outwardly angled arm segments each have a male coupling disposed on a free end thereof. A pair of shirt attachment rods are provided with each having female couplings disposed on opposed free ends thereof. The female couplings of one of upper free ends are removably mating with the male couplings of the hooked upper portion for supporting a shirt thereon. A pants attachment rod is provided having male couplings disposed on opposed free ends thereof. The male couplings of the pants attachment rods are removably mating with the female couplings on lower free ends of the pair of shirt attachments rods for supporting a pair of pants thereon. A pair of dress attachment rods are provided with each having female couplings disposed on opposed free ends thereof. The pair of dress attachment rods each have notches formed therein. The female couplings of the dress attachment rods removably mate with the male couplings of the hooked upper portion for supporting a dress thereon. A pair of skirt hooks are provided with each having male couplings disposed thereon. The male couplings of the shirt hooks removably mate with the female couplings on lower free ends of the pair of shirt attachments rods for supporting a skirt therebetween.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new convertible hanger apparatus and method which has many of the advantages of the hangers mentioned heretofore and many novel features that result in a new convertible hanger which is not anticipated, rendered obvious, suggested, or even implied by any of the prior art hangers, either alone or in any combination thereof.

It is another object of the present invention to provide a new convertible hanger which may be easily and efficiently manufactured and marketed.

It is a further object of the present invention to provide a new convertible hanger which is of a durable and reliable construction.

An even further object of the present invention is to provide a new convertible hanger which is susceptible of a low cost of manufacture with regard to both materials and labor, and which accordingly is then susceptible of low prices of sale to the consuming public, thereby making such convertible hanger economically available to the buying public.

Still yet another object of the present invention is to provide a new convertible hanger which provides in the apparatuses and methods of the prior art some of the advantages thereof, while simultaneously overcoming some of the disadvantages normally associated therewith.

Still another object of the present invention is to provide a new convertible hanger for accommodating different sizes and styles of garments.

Yet another object of the present invention is to provide a new convertible hanger which includes a hooked upper portion adapted for engaging a coat rail. The hooked upper portion has an upper hooked end and pair of outwardly angled arm segments. The upper hooked end has an engagement bar pivotally positioned within an opening thereof. The engagement bar has a lever coupled therewith. The lever has an outer free end extending outwardly opposed from the opening of the upper hooked end. The outwardly angled arm segments each have a male coupling disposed on a free end thereof. A pair of shirt attachment rods are provided with each having female couplings disposed on opposed free ends thereof. The female couplings of one of upper free ends are removably mating with the male couplings of the hooked upper portion for supporting a shirt thereon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
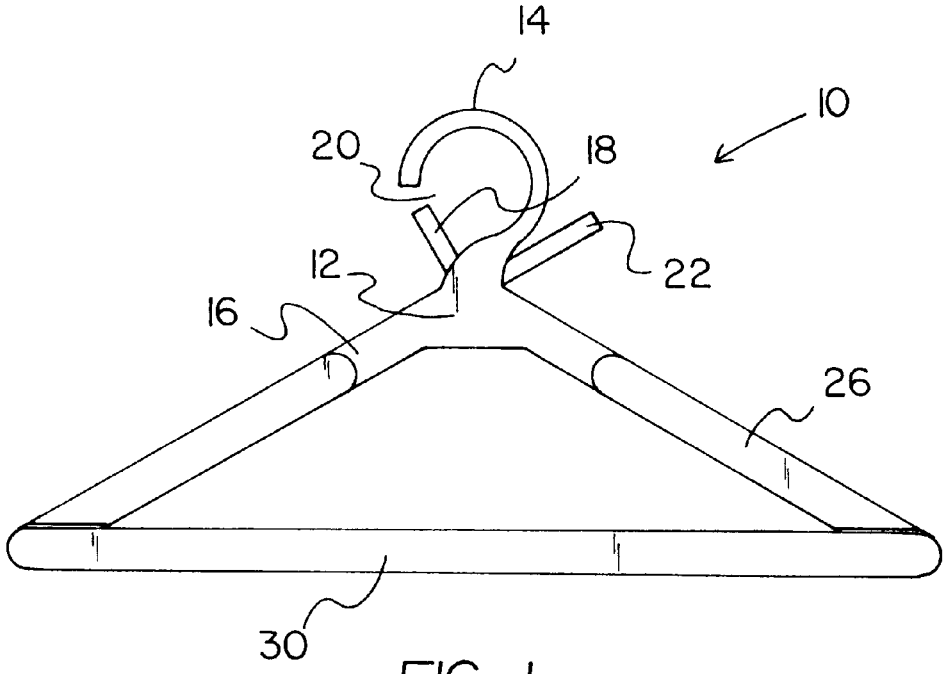
FIG. 1 is a front view of a new convertible hanger according to the present invention illustrating one use.
Figure 2:
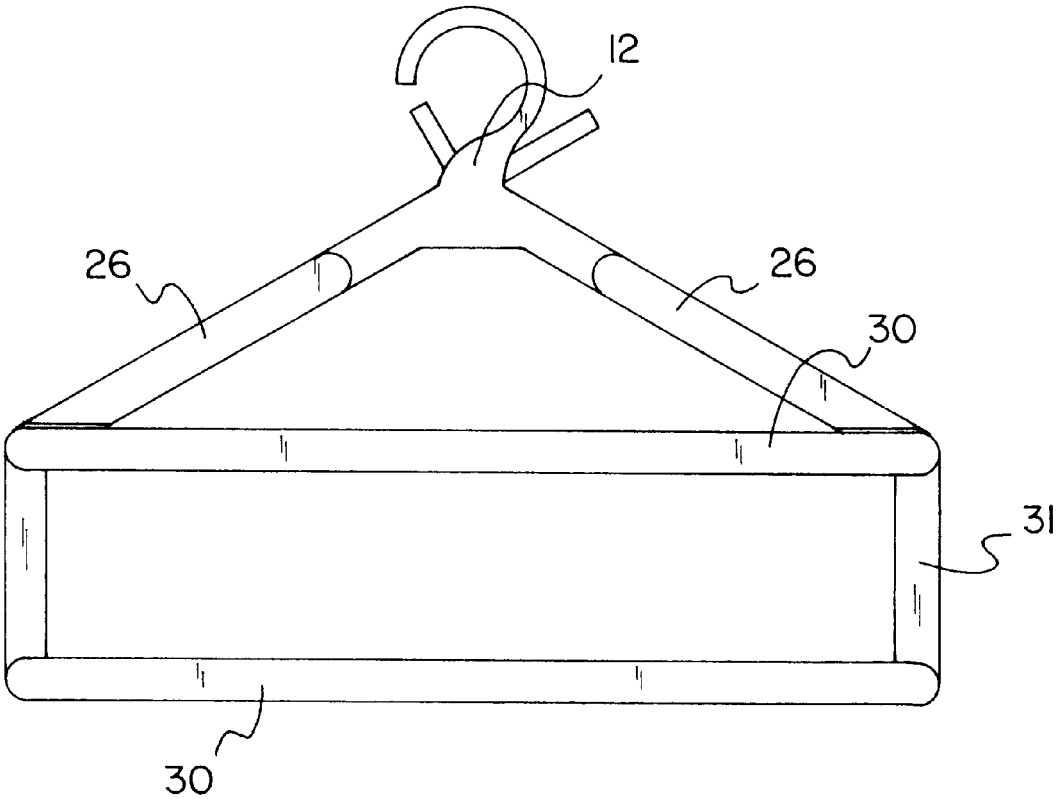
FIG. 2 is a front view of the present invention illustrating an additional use.
Figure 3:
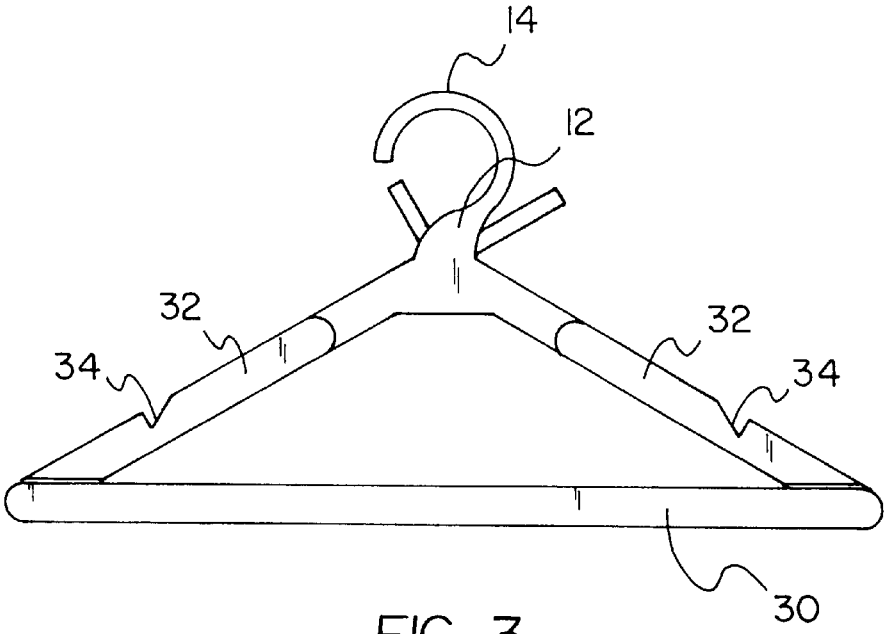
FIG. 3 is a front view of the present invention illustrating yet another use.
Figure 4:
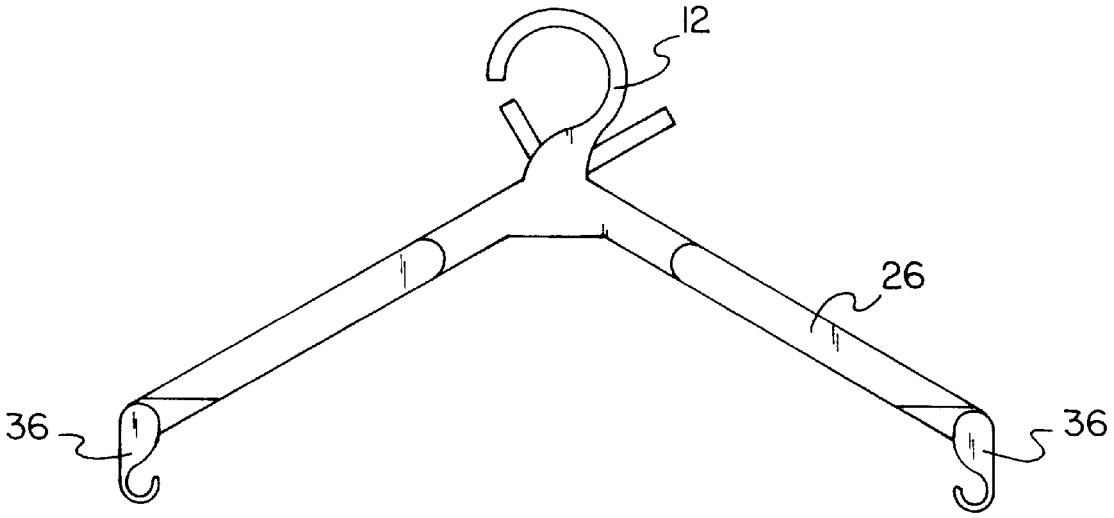
FIG. 4 is a front view of the present invention illustrating a final use.
Figure 5:
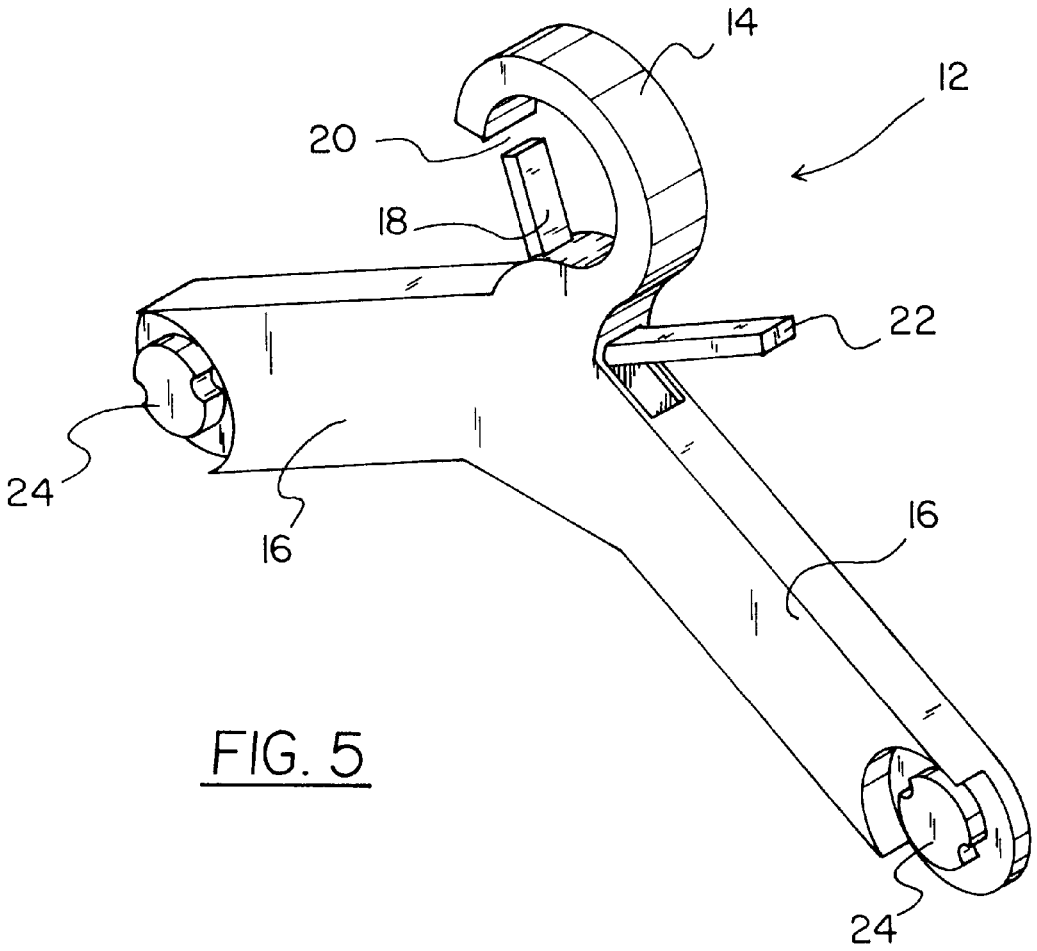
FIG. 5 is a perspective view of the hooked upper portion of the present invention illustrating the male coupling thereof.
Figure 6:
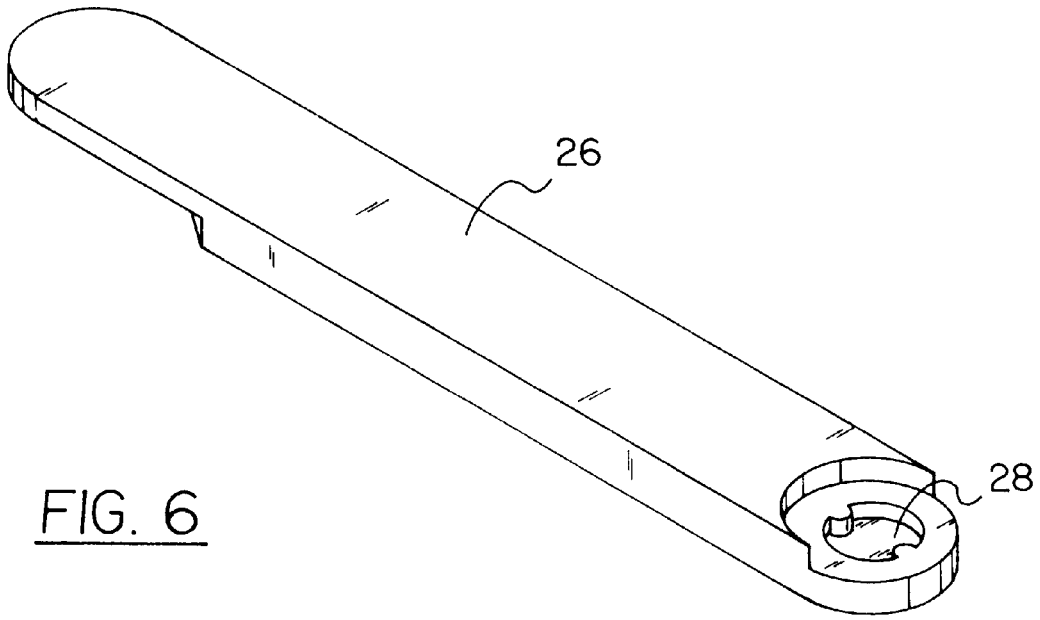
FIG. 6 is a perspective view of the present invention illustrating the female coupling thereof.
Figure 7:
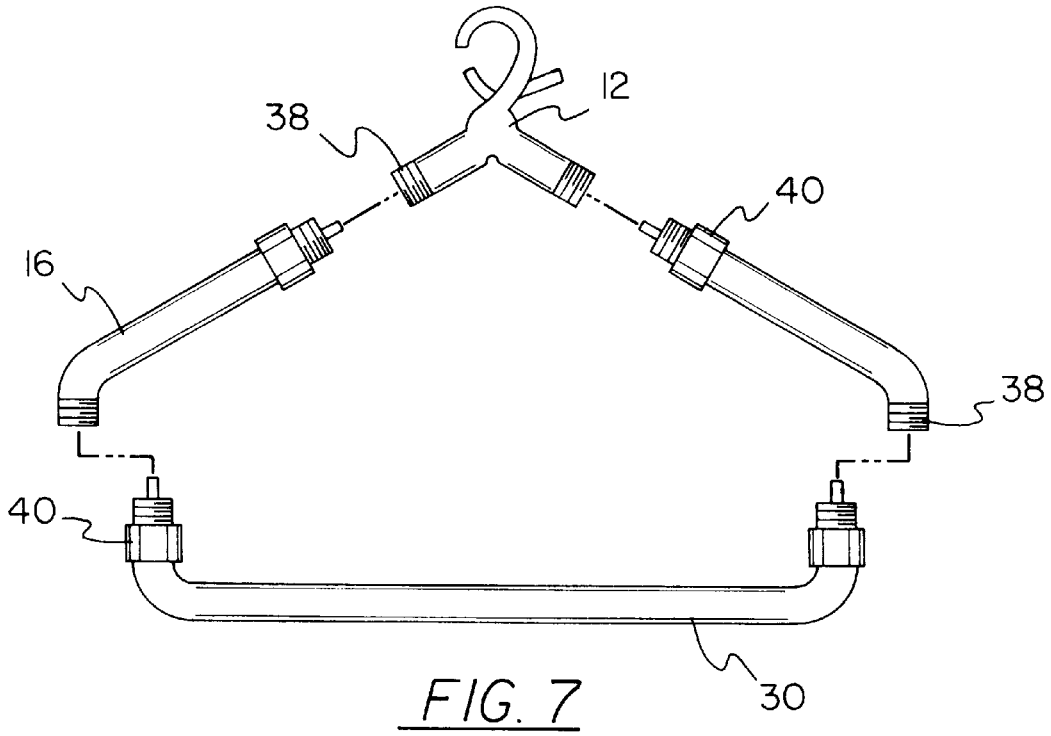
FIG. 7 is a front exploded view of an alternate embodiment of the present invention.
Figure 8:
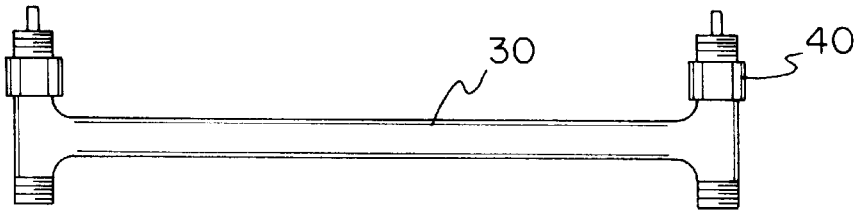
FIG. 8 is a front view of a trouser attachment for the alternate embodiment.
Figure 9:
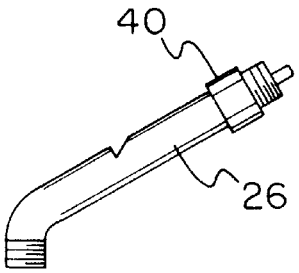
FIG. 9 is a front view of a vest attachment of the present invention.
Figure 10:
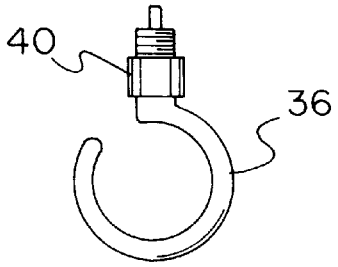
FIG. 10 is a front view of a skirt attachment of the present invention.

With reference now to the drawings, and in particular to FIGS. 1 through 10 thereof, a new convertible hanger embodying the principles and concepts of the present invention and generally designated by the reference numeral 10 will be described.

As best illustrated in FIGS. 1 through 10, the convertible hanger 10 comprises a hooked upper portion 12 adapted for engaging a coat rail. The hooked upper portion 12 has an upper hooked end 14 and pair of outwardly angled arm segments 16. The upper hooked end 14 has an engagement bar 18 pivotally positioned within an opening 20 thereof. The engagement bar 18 has a lever 22 coupled therewith. The lever 22 has an outer free end extending outwardly opposed from the opening 20 of the upper hooked end 14. By pressing down on the lever, the engagement bar 18 will pivot inwardly to expose the opening 18 and allow the hooked upper portion 12 to receive a coat rail. By releasing the lever 22, the engagement bar 18 will return to its original position thereby closing the opening 18 and precluding the inadvertent removal of the hooked upper portion 12 from the coat rail. The outwardly angled arm segments 16 each have a male coupling 24 disposed on a free end thereof.

A pair of shirt attachment rods 26 are provided with each having female couplings 28 disposed on opposed free ends thereof. The female couplings 28 of one of upper free ends removably mate with the male couplings 24 of the hooked upper portion 12 for supporting a shirt thereon.

A pants attachment rod 30 is provided having male couplings 24 disposed on opposed free ends thereof. The male couplings 24 of the pants attachment rods 30 are removably mating with the female couplings 28 on lower free ends of the pair of shirt attachments rods 26 for supporting a pair of pants thereon. An additional pants attachment rod 30 could also be attached via a pair of upper segments 31 which will allow two pairs of pants to be hung from the device.

A pair of dress attachment rods 32 are provided with each having female couplings 28 disposed on opposed free ends thereof. The pair of dress attachment rods 32 each have notches 34 formed therein. The female couplings 28 of the dress attachment rods 32 removably mate with the male couplings 24 of the hooked upper portion 12 for supporting a dress thereon. The notches 34 serve to engage the dress to prevent the dress from sliding off of the rods 32. This arrangement could be used for holding vests as well.

The various attachments are interchangeable to suit the particular garment that the hanger will be used for.

A pair of skirt hooks 36 are provided with each having male couplings 24 disposed thereon. The male couplings 24 of the skirt hooks 36 removably mate with the female couplings 28 on lower free ends of the pair of shirt attachments rods 26 for supporting a skirt therebetween.

An alternate embodiment is illustrated in FIGS. 7–10. In this embodiment, the hooked upper arm portion 12 has externally threaded end portions 38 for selectively coupling with threaded collars 40 of the outwardly angled arm segments 16. The outwardly angled arm segments 16 have externally threaded end portions 38 for selective coupling with threaded collars 40 on the pants attachment rods 30, the shirt attachment rods 26, and the skirt hook 36.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A convertible hanger for accommodating different sizes and styles of garments comprising, in combination:

a hooked upper portion adapted for engaging a coat rail, the hooked upper portion having an upper hooked end and pair of outwardly angled arm segments, the upper hooked end having an engagement bar pivotally positioned within an opening thereof, the engagement bar having a lever coupled therewith, the lever having an outer free end extending outwardly opposed from the opening of the upper hooked end, the outwardly angled arm segments each having a male coupling disposed on a free end thereof;

a pair of shirt attachment rods each having female couplings disposed on opposed free ends thereof, the female couplings of one of upper free ends removably mating with the male couplings of the hooked upper portion for supporting a shirt thereon;

a pants attachment rod having male couplings disposed on opposed free ends thereof, the male couplings of the pants attachment rods removably mating with the female couplings on lower free ends of the pair of shirt attachments rods for supporting a pair of pants thereon;

a pair of dress attachment rods each having female couplings disposed on opposed free ends thereof, the pair of dress attachment rods each having notches formed therein, the female couplings of the dress attachment rods removably mating with the male couplings of the hooked upper portion for supporting a dress thereon; and a pair of skirt hooks each having male couplings disposed thereon, the male couplings of the skirt hooks removably mating with the female couplings on lower free ends of the pair of shirt attachments rods for supporting a skirt therebetween.

2. A convertible hanger for accommodating different sizes and styles of garments comprising, in combination:

a hooked upper portion adapted for engaging a coat rail, the hooked upper portion having an upper hooked end and pair of outwardly angled arm segments, the upper hooked end having an engagement bar pivotally positioned within an opening thereof, the engagement bar having a lever coupled therewith, the lever having an outer free end extending outwardly opposed from the opening of the upper hooked end, the outwardly angled arm segments each having a male coupling disposed on a free end thereof; and a pair of shirt attachment rods each having female couplings disposed on opposed free ends thereof, the female couplings of one of upper free ends removably mating with the male couplings of the hooked upper portion for supporting a shirt thereon.

3. The convertible hanger as set forth in claim 2 and further including a pants attachment rod having male couplings disposed on opposed free ends thereof, the male couplings of the pants attachment rods removably mating with the female couplings on lower free ends of the pair of shirt attachments rods for supporting a pair of pants thereon.

4. The convertible hanger as set forth in claim 2 and further including a pair of dress attachment rods each having female couplings disposed on opposed free ends thereof, the pair of dress attachment rods each having notches formed therein, the female couplings of the dress attachment rods removably mating with the male couplings of the hooked upper portion for supporting a dress thereon.

5. The convertible hanger as set forth in claim 2 and further including a pair of skirt hooks each having male couplings disposed thereon, the male couplings of the skirt hooks removably mating with the female couplings on lower free ends of the pair of shirt attachments rods for supporting a skirt therebetween.

* * * * *